United States Patent [19]

Esposito

[11] Patent Number: 5,071,042

[45] Date of Patent: Dec. 10, 1991

[54] ADAPTER THAT PROVIDES BOTTLE-LIKE SPOUT FOR ALUMINUM BEVERAGE CANS

[75] Inventor: Jeff F. Esposito, Palm Harbor, Fla.

[73] Assignee: BNJM3, Inc., Oldsmar, Fla.

[21] Appl. No.: 478,118

[22] Filed: Feb. 7, 1990

[51] Int. Cl.[5] ..... B65D 25/48

[52] U.S. Cl. ..... 222/570; 222/542; 220/711

[58] Field of Search ..... 222/566, 570, 479, 481, 222/542; 220/85 SP, 90.4.90.6, 90.2, 287

[56] References Cited

U.S. PATENT DOCUMENTS

| | | | |
|---|---|---|---|
| 4,579,257 | 4/1986 | Brandlein | 222/192 |
| 4,715,510 | 12/1987 | van der Meulen et al. | 220/90.6 |
| 4,790,444 | 12/1988 | Terzi | 220/90.6 |
| 4,883,192 | 11/1989 | Krugman | 220/85 SP |

*Primary Examiner*—Michael S. Huppert
*Assistant Examiner*—Philippe Derakshani
*Attorney, Agent, or Firm*—Joseph C. Mason, Jr.; Ronald E. Smith

[57] ABSTRACT

An adapter that releasably engages the rim of an aluminum beverage can and which provides a bottle-like spout so that a consumer may drink from the can as if drinking from a bottle. In a first embodiment, a flexible base has radially inwardly extending lugs that releasably engage the rim of the can at circumferentially spaced locations therebout. A concave plate having a central, oval-shaped opening is fixedly secured about its periphery to inner side walls of the adapter, in vertically spaced relation to the open bottom end of the adapter. A resilient gasket circumscribes and depends from the opening and the vertical extent of the gasket is such that the bottom edge of the gasket is coplanar with the bottom of the adapter so that the gasket tightly seals a pour opening punched in the lid of the can when the adapter is detachably secured to the rim of the can. In a second embodiment, the plate, opening and gasket are eliminated and an annular ring having a pointed lower edge provides the needed seal.

11 Claims, 2 Drawing Sheets

ADAPTER THAT PROVIDES BOTTLE-LIKE SPOUT FOR ALUMINUM BEVERAGE CANS

TECHNICAL FIELD

This invention relates, generally, to devices that are releasably securable to beverage cans to increase the palatability of drinking therefrom. More particularly, it relates to a device that provides a bottle-like spout for a beverage can.

BACKGROUND ART

Many beverages such as soft drinks and beer are sold in small aluminum cans. The most common can has an imperforate metallic lid and means for punching a pour opening therein so that the beverage can be consumed.

Many people have noted the drawbacks associated with the common beverage can. The cans often sit for long periods of time in warehouses waiting for distribution to stores, for example, and warehouses are of the dirty. As a result, most consumers quickly wipe off the lids of such cans before opening them and drinking therefrom in a nominal, at best, effort to avoid germs.

Obviously, such casual wiping cleans off only the more visible dirt and has little or no effect on microscopic viruses or bacteria that may be alive and multiplying on the can top.

There is therefore a need for a device that protects consumers from having to place their mouths on beverage can tops. Quite a few inventors have tackled the problem, and numerous solutions to the problem have therefore appeared.

For example, U.S Pat. No. 4,579,257 to Brandlein shows a drinking attachment for a can top that provides a sanitary mouthpiece or spout that protrudes upwardly from an opening in a plate. The plate clamps to the circular bead or rim of the can. A sealing unit on the plate surrounds the can pour opening, and the sealing unit is made of a suitable material.

Other patents of interest include Canadian patent 952,455, German patent 197803, EP patent 5115, and U.S. Pat. No. 3,445,033, 4,066,191, 4,403,709, 4,185,496, 4,679,702, 4,703,873, 4,796,774, and 4,572,386.

However, none of the known prior art devices share the same novel structure as the invention to be disclosed hereinafter.

DISCLOSURE OF INVENTION

An adapter member having a bottle-like opening and a bottle-like neck is releasably attachable to the top of an aluminum beverage can. The base of the adapter releasably engages the upper rim of the can so that the adapter can be used repeatedly. In a first embodiment, a concave plate having a generally oval opening formed centrally thereof has its peripheral edges fixedly secured to the inner surface of the base and is spaced a predetermined distance above the open bottom end of the adapter. A resilient gasket circumscribes the opening and depends therefrom. More particularly, the gasket extends from the lower surface of the concave plate to the open end of the adapter. When the base of the adapter is placed into releasable engagement with the rim of the can, the gasket circumscribes the pour opening punched in the lid of the can and is compressed to tightly seal said opening against leakage.

Thus, when the beverage is imbibed, it does not contact the lid of the can; instead, the beverage is restricted to flowing over the inside surfaces of the adapter and the upper surface of the concave plate. The concavity of said plate directs liquids thereatop back into the can through the pour opening.

In a second embodiment, the concave plate is eliminated and the adaptor has different means for engaging the rim of the can.

It is therefor clear that an important object of this invention is to provide an adapter that protects consumers from encountering germs of the type that might exist on the lids of aluminum beverage cans.

Another object is to enable the consumer to drink from a bottle-like spout since such spouts are more appealing than are can tops to most consumers.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
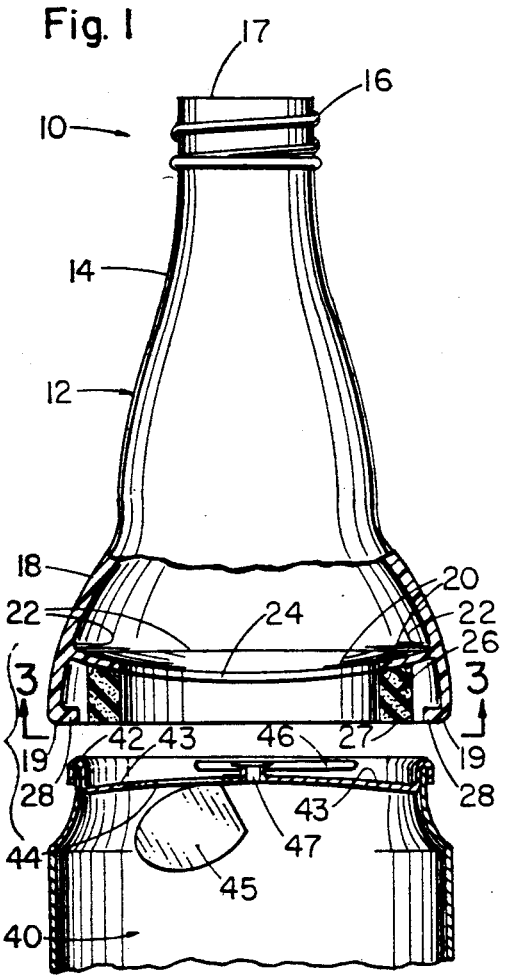
FIG. 1 is a exploded view, partially in cross section, of a preferred embodiment of the invention.

Referring now to FIG. 1, it will there be seen that an exemplary embodiment of the novel invention is denoted by the reference numeral 10 as a whole.

Adapter 10 includes main body part 12, a tapered neck 14 having external screw threads 16 formed at the top thereof, an open mouth 17, and a base part 18 that is flared radially outwardly with respect to said main body part 12 as shown.

Adapter 10 has an annular bottom edge 19. A concave plate 20 is fixedly secured at its outermost peripheral edges to the inner surface of base 18 as at 22. The annular point of attachment 22 of plate 20 to said inner surface is spaced a predetermined distance above the open end of adapter 10 as clearly depicted in FIG. 1.

A generally oval in configuration opening 24 is formed centrally of concave plate 20. A resilient gasket 26 having a flat bottom edge 27 circumscribes opening 24 and depends therefrom as perhaps best understood by comparing FIGS. 1 and 2, i.e., the top edge of the gasket is fixedly secured to the bottom side of concave plate 20.

Importantly, the vertical extent of gasket 26 is sufficient to extend from the lower surface of concave plate to the bottom edge 19 of adapter 10. In other words, the flat bottom edge 27 of gasket 26 is coplanar with the bottom edge 19 of adapter 10 as shown in FIG. 1.

Figure 2:
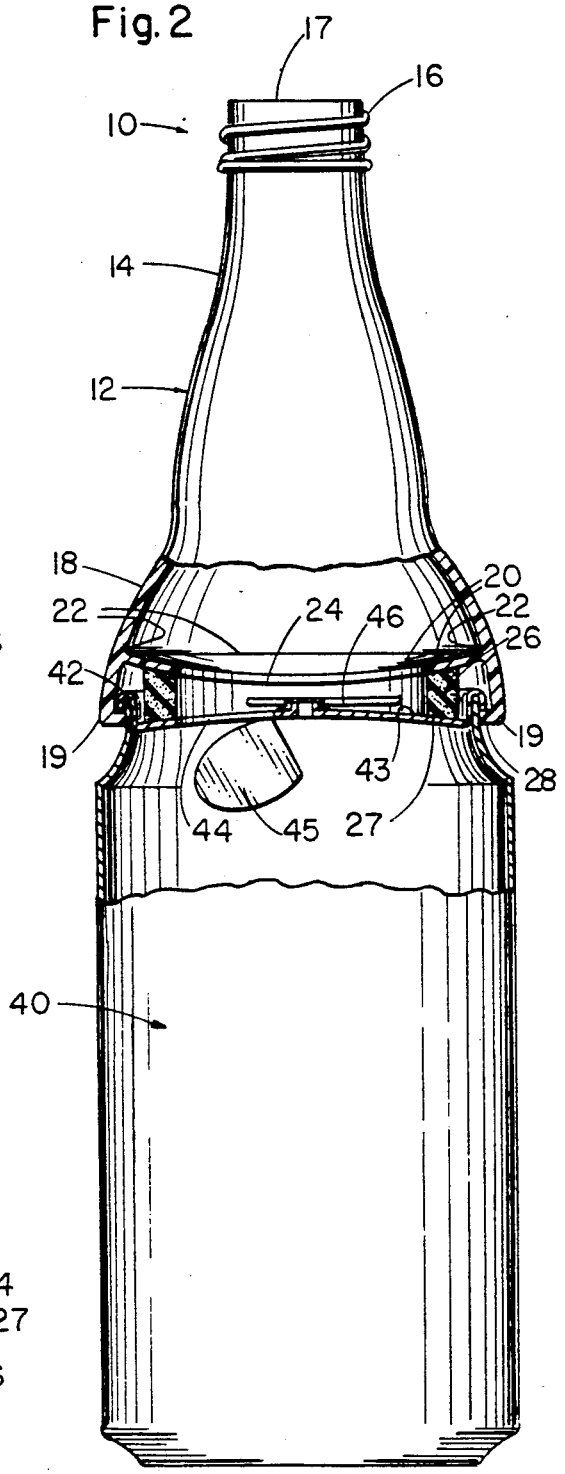
FIG. 2 is a partially sectional view of the adapter of FIG. 1 when attached to a conventional aluminum beverage can.
Figure 3:
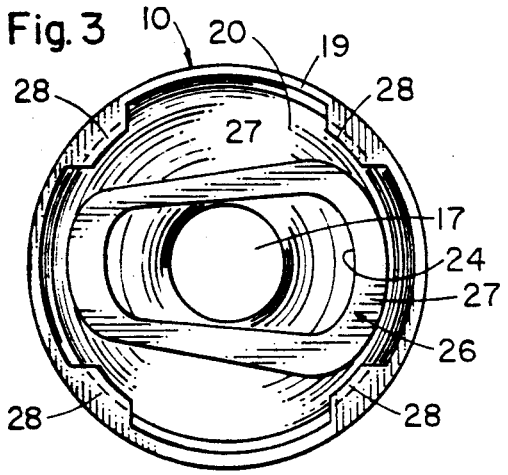
FIG. 3 is a bottom view of the adapter taken along line 3—3 in FIG. 1.

Conventional aluminum beverage can 40 has a beaded rim 42. To use adapter 10, a pour opening 44 is made in the can's top wall 43 by punching out top section 45 with a tab 46 by pivoting said tab 46 about its fulcrum 47 in the well known manner, and the open lower end of adapter 10 is lowered over the upper end of the can as depicted in FIG. 2. A plurality of circumferentially and equidistantly spaced, radially inwardly extending lugs 28 formed integral with bottom edge 1 of adapter 10 releasably engage the underside of rim 42 as shown in FIG. 3. More particularly, base 18 is sufficiently pliable to permit lugs 28 to be transiently displaced radially outwardly by rim 42 and said base is sufficiently resilient to cause said lugs 28 to travel radially inwardly after they have traversed the upper, widest part of the rim 42 as should be clear from a comparison of FIGS. 1 and 2. In this manner, lugs 28 snap fittingly engage rim 42.

It is also important to note that top 43 of can 44 is convex in configuration and that the flat bottom surface 27 of gasket 26 is deformed by said convexity, i.e., bottom surface 27 conforms to the contour of top 43 when lugs 28 engage rim 42 as is clearly shown in FIG. 2. Thus, gasket 26 forms a tight seal around opening 44 and tab 46, thereby preventing flow of liquid thereunder and constraining the liquid to flow first through pour opening 44 in lid top 43, secondly through opening 24 in concave plate 20, and thirdly through opening 17 when the can 40 is at least partially inverted.

The provision of threads 16 enables the consumer to cap the can 40 and adapter 10 so that the entire contents of the can need not be consumed at one time.

Adapter 10 is preferably made of a high impact plastic or other suitable material and accordingly has the look and feel of glass. It can be quickly and easily attached and detached to and from virtually any aluminum beverage can currently in use. Its use eliminates direct contact between the mouth of the consumer and the can top and provides the more pleasing feel of a bottle as well.

Figure 4:
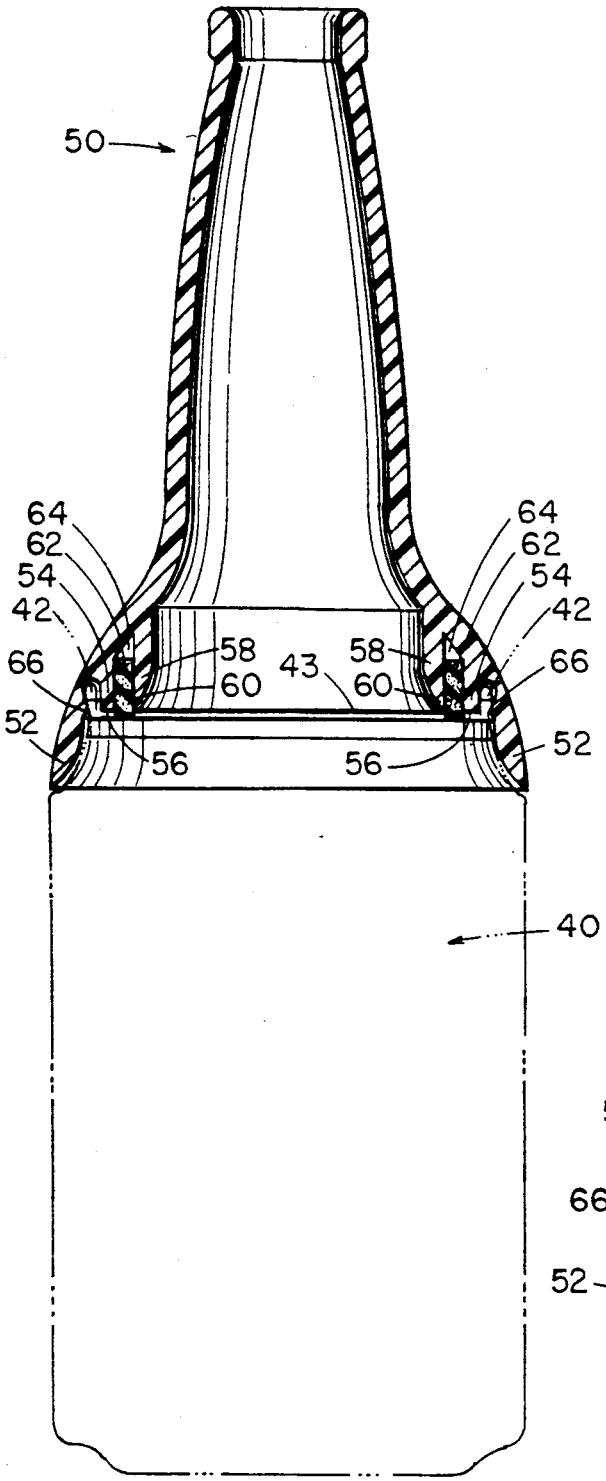
FIG. 4 is a partial sectional view of a second embodiment of the adaptor.
Figure 5:
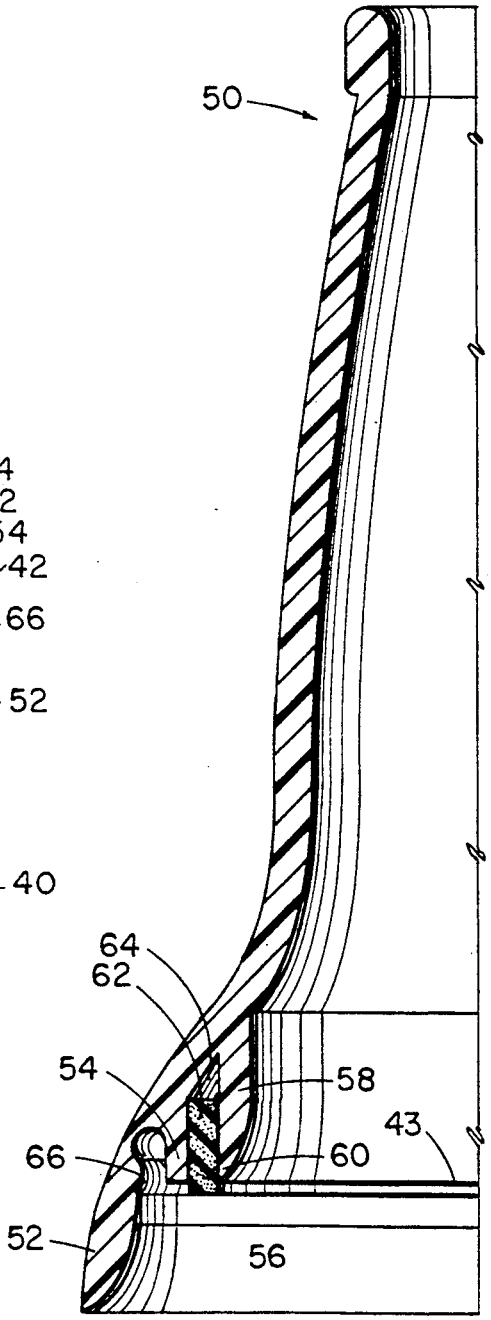
FIG. 5 is an enlarged view of the structure shown in FIG. 5.

Referring now to FIGS. 4 and 5, it will there be seen that a second embodiment of the invention is denoted as a whole by the reference numeral 50; this second embodiment is the preferred commercial embodiment of the invention.

It will be observed in those Figs. that the commercial embodiment of the invention does not include concave plate 20 and hence does not include the oval opening 24 formed therein or the gasket 26 that depends therefrom. Other structural features are also different as will be seen.

More particularly, beaded rim 42 of can 40 is releasably engaged by depending annular skirt 52 and annular retainer 54, i.e., said rim 42 is snug fittingly engaged in sandwiched relation between said skirt and retainer. Those skilled in the mechanical arts will note that the extension of skirt 52 below the rim 42 as shown, so that said skirt overlies the cylindrical side walls of the can, provides increased structural stability for the adapter 50. Such increased stability is not provided in the first embodiment of this invention.

A shallow annular protuberance 66 is formed in skirt 52 as shown to conform the interior surface thereof to a complementally formed annular recess in rim 42 of the can 40.

Retainer 54 has a flat annular lower edge 56 and abuttingly engages top wall 43 of can 40 when adaptor 50 is secured to can 40 as shown.

Annular sealing member 58 has a pointed lower edge as at 60; said sealing member 58 is concentric with retainer 54 and is spaced radially inwardly therefrom as shown, by a predetermined distance. Said sealing member 58 is also concentric with depending skirt 52 and is spaced radially inwardly therefrom. Note that retainer 54 and sealing member 58 have a common extend and that the extent of depending skirt 52 is greater than said common extent. Also note that said depending skirt, said annular retainer and said annular sealing member are substantially radially equidistantly spaced with respect to one another.

An O ring 62 is optionally positioned within the annular open bottomed groove 64 defined between retainer 54 and sealing member 58 to seal the Bottle It (TM) against leakage when in use, but tests have shown that use of the sealing 0 ring 62 is not critical in that the pointed end 60 of ring 58 seems to adequately seal the unit from leaks.

Clearly, the invention is new and useful. Moreover, it was not obvious to those of ordinary skill in the art at the time it was made, in view of the prior art, taken as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An adapter for attachment to a beverage can, comprising:

an adapter main body;

a tapered neck integral to said main body;

a base integral to said main body;

said neck, main body and base being of generally tubular configuration and having a predetermined configuration and dimension substantially equal to the configuration and dimension of a spout region of a bottle;

means for detachably securing said base to the rim of a beverage can;

a concave plate disposed in a predetermined position interiorly of said base;

said concave plate being disposed in vertically spaced apart relation to a top wall of said beverage can;

an opening of predetermined dimension and configuration being configuration being formed in said concave plate at a predetermined location; and a resilient gasket fixedly secured to and depending from an underside of said concave plate, in circumscribing relation to said opening;

said gasket, when in repose, extending from said plate to a plane coextensive with a lowermost edge of said adapter base; and said gasket being under compression when said adapter base is engaged to said beverage can;

whereby when said base is detachably secured to said rim, said gasket circumscribes and seals a pour opening formed in the top wall of said can so that a beverage may flow from said pour opening through said concave plate opening, into the hollow interior of said adapter and out said neck.

2. The adapter of claim 1, wherein said means for detachably securing said base to the rim of a beverage can includes a plurality of circumferentially spaced lug members that extend radially inwardly from a bottom edge of said base.

3. The adapter of claim 2, wherein the predetermined location of said opening formed in said concave plate is substantially the center thereof.

4. The adapter of claim 3, wherein the predetermined location of said opening formed in said concave plate is substantially the center thereof.

5. The adapter of claim 4, further comprising screw threads being formed on said neck to accommodate a closure means.

6. An adapter for attachment to a beverage can of the type having a beaded rim and cylindrical side walls, comprising:

an adapter main body;

a tapered neck integral to said main body;

a base integral to said main body;

said neck, main body and base being of generally tubular configuration and having a predetermined configuration and dimension substantially equal to the configuration and dimension of a spout region of a bottle;

rim-engaging means for releasably engaging said beaded rim;

said rim-engaging means including a depending annular skirt and an annular retainer positioned radially inwardly of said skirt, said beaded rim being disposed in sandwiched relation between said skirt and said annular retainer;

an annular sealing member being disposed radially inwardly of said annular retainer;

said annular retainer and said annular sealing member having a common predetermined extent;

said depending skirt having a predetermined extend greater than the common predetermined extent of said annular retainer and said annular sealing member;

said depending skirt extending a predetermined distance below said beaded rim so that it overlies the cylindrical side walls of said can and provides structural stability to the adapter;

said annular retainer having a flat bottom edge that abuttingly engages a beverage can top wall when said adapter is releasably secured thereto;

said annular sealing member having a pointed bottom edge that abuttingly engages said beverage can top wall when said adapter is releasably secured thereto;

said depending skirt, said annular retainer and said annular sealing member being concentrically disposed with respect to a longitudinal axis of symmetry of said adapter; and said depending skirt, said annular retainer and said annular sealing member being substantially radially equidistantly spaced apart with respect to one another.

7. The adapter of claim 6, further comprising an O ring positioned in snug fitting engagement between said annular retainer and said sealing member to further prevent leakage of liquids from said adapter.

8. The adapter of claim 7, wherein said annular retainer and said sealing member have a first, common predetermined extent and wherein said annular skirt has a second predetermined extent greater than said first predetermined extent.

9. The adapter of claim 8, wherein said sealing member and said annular retainer abuttingly engage a top wall of said can when said adapter is releasably secured thereto.

10. The adapter of claim 9, wherein said annular retainer has a flat bottom edge.

11. The adapter of claim 10, wherein said sealing member has a pointed bottom edge.

* * * * *